US012180805B2

(12) United States Patent
Kumar et al.

(10) Patent No.: US 12,180,805 B2
(45) Date of Patent: Dec. 31, 2024

(54) FLOTATION APPARATUS FOR PROVIDING BUOYANCY TO TUBULAR MEMBERS

(71) Applicant: NATIONAL OILWELL VARCO, L.P., Houston, TX (US)

(72) Inventors: Mahesha Kumar, Houston, TX (US); Aju Abraham, Houston, TX (US); William Lynn Beason, Houston, TX (US); John Chrysostom Wolf, Texas, TX (US); Michael Scott Brackin, Houston, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 263 days.

(21) Appl. No.: 17/422,546

(22) PCT Filed: Jan. 10, 2020

(86) PCT No.: PCT/US2020/013031

§ 371 (c)(1),
(2) Date: Jul. 13, 2021

(87) PCT Pub. No.: WO2020/150083

PCT Pub. Date: Jul. 23, 2020

(65) Prior Publication Data

US 2022/0349276 A1 Nov. 3, 2022

Related U.S. Application Data

(60) Provisional application No. 62/794,235, filed on Jan. 18, 2019.

(51) Int. Cl.
*E21B 34/06* (2006.01)
*E21B 33/12* (2006.01)

(52) U.S. Cl.
CPC ..... *E21B 34/063* (2013.01); *E21B 33/1208* (2013.01)

(58) Field of Classification Search
CPC ..... E21B 34/063
See application file for complete search history.

(56) References Cited

U.S. PATENT DOCUMENTS 4,338,114 A * 7/1982 Brockway ..... C03B 29/04 219/121.85
6,378,544 B1 * 4/2002 DiBello ..... F16K 17/16 137/68.27

(Continued)

OTHER PUBLICATIONS

International Search Report and Written Opinion for PCT/US/2020/013031 dated Mar. 11, 2020 (19 pages).

(Continued)

*Primary Examiner* — Theodore N Yao
(74) *Attorney, Agent, or Firm* — CONLEY ROSE, P.C.

(57) ABSTRACT

A downhole tool includes a housing configured to be connected between two tubular members. The housing includes a chamber and a plug assembly is disposed in the chamber and divides the chamber into an up-hole portion and a downhole portion. The plug assembly includes a glass member having a predetermined residual surface compression, at least a first face, and at least one strength-reducing surface feature on the first face. The strength-reducing surface feature is configured to cause the glass member to disintegrate when the glass member is exposed to a pressure in the up-hole portion of a magnitude that creates a tensile stress on the first face that exceeds the predetermined residual surface compression.

30 Claims, 6 Drawing Sheets

(56) References Cited

U.S. PATENT DOCUMENTS

| | | | | |
|---|---|---|---|---|
| 2007/0012438 | A1* | 1/2007 | Hassel-Sorensen | E21B 33/1208 166/250.08 |
| 2007/0163776 | A1* | 7/2007 | Sorensen | E21B 33/12 166/179 |
| 2009/0101358 | A1* | 4/2009 | Bjorgum | E21B 34/063 166/376 |
| 2014/0216756 | A1* | 8/2014 | Getzlaf | E21B 7/20 166/376 |
| 2014/0370217 | A1* | 12/2014 | Perez | C09D 163/00 428/323 |
| 2016/0273300 | A1 | 9/2016 | Walton | |
| 2017/0022783 | A1 | 1/2017 | Yong | |
| 2017/0159419 | A1 | 1/2017 | Tolman | |
| 2018/0156002 | A1 | 6/2018 | Brandsdal | |
| 2019/0017345 | A1* | 1/2019 | Brandsdal | E21B 34/063 |
| 2019/0032448 | A1* | 1/2019 | Bjørgum | E21B 34/063 |
| 2021/0188689 | A1* | 6/2021 | Bjørgum | C03B 35/005 |
| 2022/0251922 | A1* | 8/2022 | Hiorth | E21B 34/063 |

OTHER PUBLICATIONS

Canadian Office Action dated Jan. 19, 2024, for Canadian Application No. 3,127,060 (4 p.).

* cited by examiner

FLOTATION APPARATUS FOR PROVIDING BUOYANCY TO TUBULAR MEMBERS

CROSS-REFERENCE TO RELATED APPLICATIONS

This application claims benefit of U.S. provisional patent application Ser. No. 62/794,235 filed Jan. 18, 2019, and entitled "Flotation Apparatus for Providing Buoyancy to Tubular Members," which is hereby incorporated herein by reference in its entirety.

STATEMENT REGARDING FEDERALLY SPONSORED RESEARCH OR DEVELOPMENT

Not applicable.

BACKGROUND

Field of the Disclosure

This disclosure relates generally to installing tubular members into wellbores. More particularly, it relates to an apparatus and system for installing tubular members into wellbores that include a horizontal portion. Still more particularly, this disclosure relates to flotation devices added to strings of tubular members to provide a measure of buoyancy and to aid when installing tubular members into wellbores that include a horizontal portion.

Background to the Disclosure

Conventional flotation devices are used to install a string of tubular members or tools into a wellbore that includes a lateral section(s) that is highly-deviated and may be horizontal. The wellbore typically contains a wellbore fluid from the formation or from the rig that is working the wellbore. The conventional flotation device commonly includes a sealing member to contain and isolate air or another gas within a lower portion of the string to cause the lower portion to float within the horizontal section of the wellbore, reducing friction drag as the string moves into the well. Fluid is added within an upper portion of the string to provide weight to push the string into the wellbore. At various locations along the wellbore, the string being installed may come to engage exposed formation material, tubular casing, or annular sections of cement. As an example, flotation devices are used to install completion strings, such as casing strings, in a wellbore in association with a cementing process during the completion of an oil or gas well. Several designs of flotation devices are available, each having its own benefits or limitations. Some conventional flotation devices include seal members that are later machined-away by a drill bit, while others include a breakable seal member that require the use of a screen to capture broken pieces.

Considering the issue further, an increase in the lateral length or increase in the horizontal length of a well's sections causes the running of a string of tubular casing members (which may be called, simply, a "casing string or a "casing,") to total depth to be more challenging. As the length of the lateral well section increases, the drag and friction force, which obstructs the process of pushing the casing to total depth, also increases. Drag between the casing string and the formation can often exceed the load capacity of the casing hook. This is a significant challenge for shale wells, which benefit from using casing hole completions that optimize wellbore integrity and ensure the success of fracturing operations.

The use of casing flotation equipment is one type of solution for these kinds of downhole problems. The floating casing bottom or lower portion is a widely-used option. Conventional casing flotation devices use air or light fluid that is trapped in the lower section of the casing string to create a buoyant chamber on the casing's lower end. This buoyant chamber can significantly reduce the weight of casing resting on the wellbore, and reduce drag, and friction, which potentially can cause buckling or sticking during the casing running process. While installing the casing, the upper, vertical section of the casing is filled with liquid and provides the weight required to reach total depth. The length of the buoyant chamber can vary based on the reduction in drag required to successfully run the casing to total depth. Preferably the wellbore is in a well-conditioned state prior to running casing to avoid issues presented by static mud gelation. If a washout, ledge, hole collapse, or sloughing shale is encountered, it may prove difficult to pass even with the benefit of conventional flotation devices.

BRIEF DESCRIPTION OF THE DRAWINGS

For a detailed description of the disclosed exemplary embodiments, reference will now be made to the accompanying drawings, wherein.

NOTATION AND NOMENCLATURE

Figure 1:
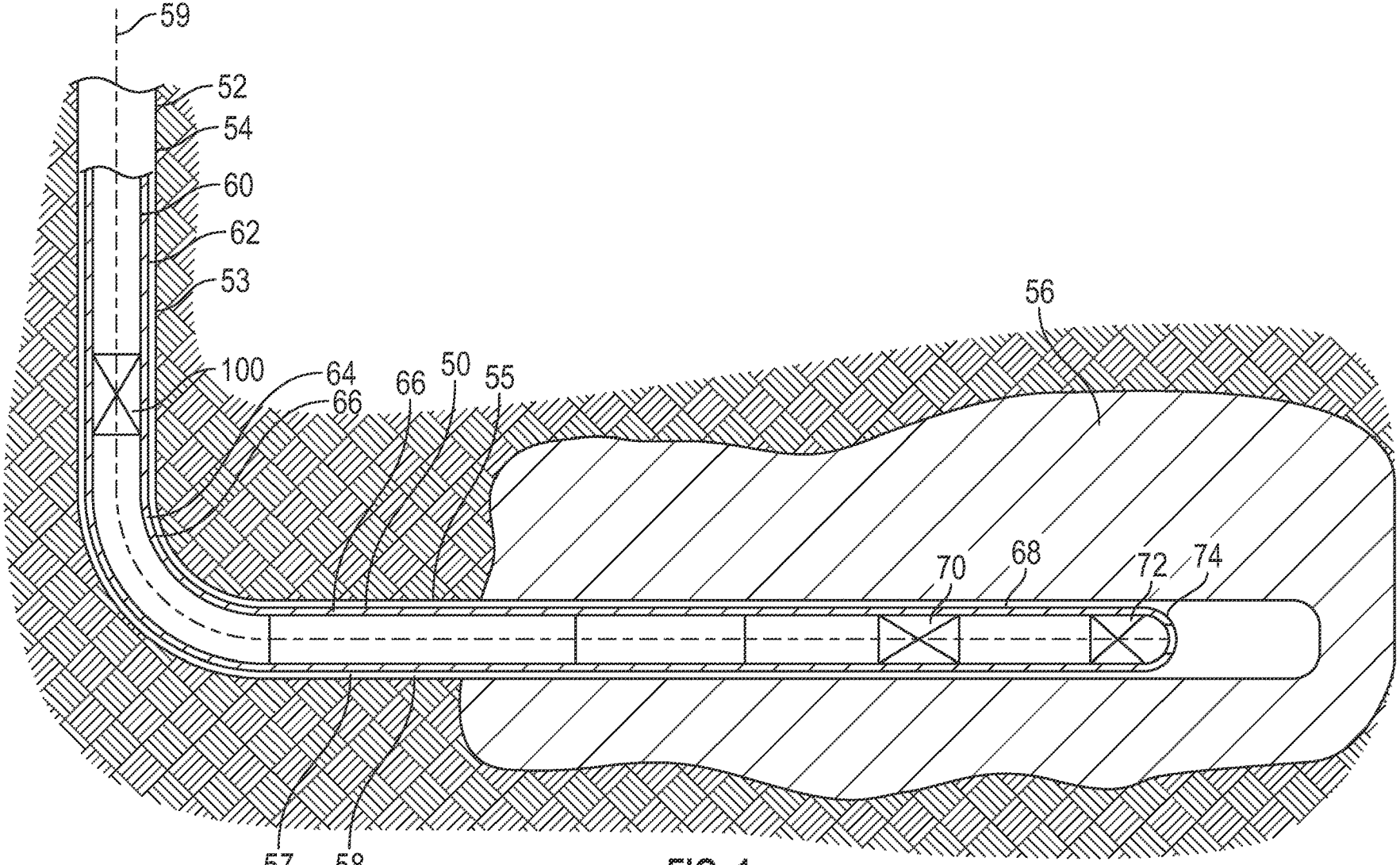
FIG. 1 shows a perspective front view of an embodiment of a completion string having a flotation device in accordance with principles described herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not drawn to-scale. Certain features and components disclosed herein may be shown exaggerated in scale or in somewhat schematic form, and some details of certain elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, then X may be based on Y and on any number of other factors. The word "or" is used in an inclusive manner. For example, "A or B" means any of the following: "A" alone, "B" alone, or both "A" and "B."

In addition, the terms "axial" and "axially" generally mean along or parallel to a given axis, while the terms "radial" and "radially" generally mean perpendicular to the axis. For instance, an axial distance refers to a distance measured along or parallel to a given axis, and a radial distance means a distance measured perpendicular to the axis. Furthermore, any reference to a relative direction or relative position is made for purpose of clarity, with examples including "top," "bottom," "up," "upper," "upward," "down," "lower," "clockwise," "left," and "right." For example, a relative direction or a relative position of an object or feature may pertain to the orientation as shown in a figure or as described. If the object or feature were viewed from another orientation or were implemented in another orientation, it may then be helpful to describe the direction or position using an alternate term. In regard to a wellbore, "up," "upper," "upwardly," "upstream," and similar terms mean toward the point of entry of the wellbore at the surface of the earth, and "down," "lower," "downwardly," "downstream," and similar terms mean toward the terminal end of the wellbore, regardless of the wellbore's physical orientation or path.

DETAILED DESCRIPTION OF THE DISCLOSED EXEMPLARY EMBODIMENTS

This disclosure describes various flotation devices that may be used with tubular strings, such as casing strings, to create a gas-filled buoyancy chamber. A buoyancy chamber is advantageous when a casing string is being installed into a lateral well, meaning a well having a wellbore that includes a lateral section(s) that is deviated from a vertical section. In some examples, a lateral section of a wellbore is highly-deviated or horizontal. The floating devices described herein are self-contained and may be decommissioned by pressure, which may be applied from the surface of the well through fluid disposed within a casing string. For decommissioning, these embodiments do not require a tool (e.g. a drill bit) to be inserted or operated from the surface, avoiding traveling into and tripping out of the well, saving time.

The flotation devices disclosed herein comprises an engineered stack of tempered glass discs or an engineered single tempered glass disk and a packaging or retention system to retain and secure the disk(s). To simplify the description, a flotation device having a stack of glass discs will be described, but the following discussion also applies to a device having a single disk. The stack of discs is securely placed inside a housing by means of adjustable retainer, and the housing is configured to integrate with a casing string. Plastic buttons or spacers and elastomer components are positioned around the glass disk(s) to protect them during the transportation and when being run in hole. An O-ring is used to seal a glass disk to create the buoyancy chamber below the flotation device In some embodiments, the stack of layered glass discs is an assembly of two, three, or more individual glass discs. For example, some assemblies include a "seal" disk, "adjustment" or "spacer" disk(s), and a "control" disk. The flotation device is characterized by an operating pressure and a burst pressure that can be tuned using particular thicknesses and numbers of seal, adjustment, and control discs and possibly other parameters or features to reliably withstand a specified amount of static pressure and fail at a specified pressure overload. In some examples, the burst pressure is 110% of the designed operating pressure. More rigorously, burst pressure and operating pressure relate to pressure differentials across the thickness (i.e., the axial direction) of the discs. For applications where a single glass disk is used, the single glass disk serves as both the seal and control disk. The failure mechanism of the flotation device is achieved through the control disk. An artificially induced, strength-reducing surface feature, which may also be described as a controlled flaw, is applied to the control disk, predisposing it to fail in a predictable manner at a specified stress level or pressure. The strength-reducing surface feature can be introduced using a number of methods, processes, or patterns which, in various embodiments, include scratches, abrasions, hard body impacts, laser etching, grit blasting, sanding, ceramic enamel coatings, other types of surface coatings, or internal stress raising impurities or voids that occur within the body of the glass, as examples.

After the casing string reaches the total depth, access through the flotation device is gained by applying a predetermined fluid pressure, i.e. the burst pressure, within the casing to burst the stack of glass discs. The burst pressure may be applied by equipment located at the earth's surface, for example by adding more fluid or by increasing the average density of the fluid in the casing to increase the hydrostatic head of the column of fluid. Once the assembly of glass discs bursts, unrestricted access through the flotation device to a lower portion of the casing string is achievable. Due to the nature of tempered glass, when the discs fracture, they fragment into very small pieces, providing a near instant, unobstructed path through the flotation device for further well-completion activities. In various strings that include some embodiments of these disclosed flotation devices, the casing string is assembled without a debris sub due to the small particle size of debris that is generated when the tempered glass discs burst. The particle size is controlled by the level of temper in the glass disks. For various embodiments of the flotation device, the small particles that result when the glass discs burst can pass through downstream passages. In addition, a sloped or smoother transition within a chamber or passageway of the flotation device may be achieved by using a dissolvable material to support the assembly of glass disk(s). The embodiments disclosed herein are configured so that the stack of glass discs will burst in a controllable, predictable manner by application of a predetermined fluid pressure without requiring an actuator to interact with one or more of the glass discs, e.g. without requiring a mechanical device to impact a glass disk.

An Exemplary Embodiment

Referring to FIG. 1, in an example, a completion string 50 is located in a wellbore 52 of a well 54 that extends into a subterranean zone 56 that contains oil or gas or is believed to be a potential source of oil or gas. Wellbore 52 includes a vertically extending, up-hole portion 53 and a downhole, lateral portion 55 that is highly-deviated or horizontal. The installation of string 50 defines an annular space 57 within wellbore 52. Wellbore 52 and its annular space 57 contain a liquid 58. In various examples, the liquid is naturally occurring or is introduced by earlier well operations. The liquid may include oil or water as examples.

In this exemplary embodiment, completion string 50 extends along a longitudinal axis 59 and includes an upper portion or upper tubular segment 60, a lower portion or lower tubular segment 64, and a toe segment 68. String segment 60 includes one or more tubular members 62 within the up-hole portion 53 of wellbore 52, and string segment 64 includes one or more tubular members 66 within the lateral portion 55. Toe segment 68 is coupled to the lower tubular segment 64 by a float collar 70 and terminated by a float shoe 72. Shoe 72 and, therefore, completion string 50 extend to a distal end 74. Completion string 50 also includes a flotation device 100 separating the lower tubular segment 64 from the upper tubular segment 60, providing a fluid-tight seal between segments 60, 64 in accordance with principles described herein. Float collar 70 creates a fluid-tight seal at the distal end of lower segment 64. Along the length of string 50, segment 60 is located at an up-hole position with respect to lower segment 64, referring to string 50 whether or not it is installed within a wellbore. In various examples, upper tubular segment 60 extends to the surface of well 54. In some embodiments, lower tubular segment 64 and tubular members 66 are similar or equivalent to upper tubular segment 60 and tubular members 62, respectively; although, the lengths of segments 60, 64 may differ. In various embodiments, string 50 may also be called a casing string 50.

While installing string 50 into wellbore 52, lower tubular segment 64 is gas-filled and liquid is added within the upper tubular segment 60 to provide weight to push lower tubular segment 64 and toe segment 68 further into wellbore 52. Flotation device 100 holds gas in lower segment 64, creating a buoyancy chamber, allowing segment 64 to float in the liquid within the liquid in annular space 57 of the wellbore's lateral portion 55. In some instances, some portions of wellbore 52 have another casing cemented and string 50 is installed through it into a lower portion of wellbore 52. The gas in segment 64 may be air or nitrogen, as examples. In various examples, the gas (e.g., air) that is present in tubulars 66 during storage or during assembly is the gas that is contained within the buoyancy chamber, and becomes trapped within the buoyancy chamber after device 100 is installed. Although, flotation device 100 is shown in the up-hole portion 53 of the wellbore, during some operations for some embodiments, flotation device 100 is moved in to the lateral portion 55 of the wellbore.

Figure 2:
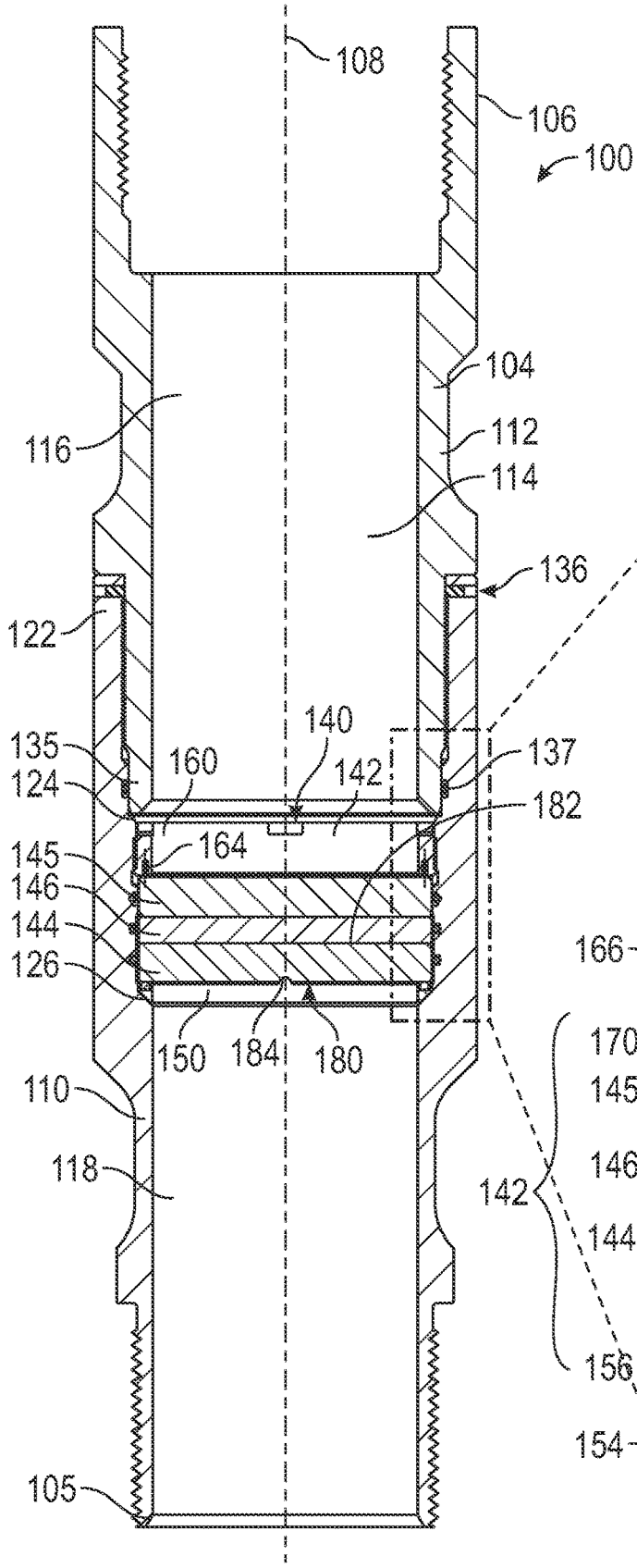
FIG. 2 shows a cross-sectional view of the flotation device of FIG. 1, the flotation device having a plug assembly with a control disk, an adjustment disk, and a seal disk of tempered glass, in accordance with principles described herein.

Referring now to FIG. 2, flotation device 100 is a tubular component that includes an elongate tubular housing 104 extending along a central or longitudinal axis 108 and includes a plug assembly 140 located within housing 104 and having a breakable barrier 142. Flotation device 100 is designed for downhole operation and may be called a downhole subassembly. Housing 104 extends from a lower housing end 105 to an upper housing end 106 and includes a pair of elongate, axially aligned tubular members 110, 112 that are threadedly connected. A tubular, lower housing member 110 is threadedly coupled to a tubular, upper housing member 112. A chamber 114 extends through housing members 110, 112 between housing ends 105, 106. Plug assembly 140 and its breakable barrier 142 are positioned in chamber 114, dividing chamber 114 into an up-hole portion 116 and a downhole portion 118. When flotation device 100 is installed in a string, such as string 50, breakable barrier 142 separates the lower tubular segment 64 from the upper tubular segment 60 before the breakable barrier is caused to fail. Failure of barrier 142 can be intentionally induced by adding pressure within upper segment 60, allowing full-diameter access through device 100 for fluid communication and tool movement. Lower housing member 110 extends from lower end 105 to an upper end 122. Lower end 105 is externally threaded and may be called a pin end, configuring it to couple the housing 104 to lower segment 64 on string 50. Upper end 122 is internally threaded. A counterbore 124 extends into lower housing member 110 from upper end 122, forming an enlargement within chamber 114 and forming a housing shoulder 126. Counterbore 124 of housing member 110 receives plug assembly 140, which rests against shoulder 126 below member 112. Upper housing member 112 extends from a lower end 135 to upper end 106. Lower end 135 and is externally threaded, configuring it to couple to upper end 122 of housing member 110. In FIG. 2, the coupled ends 122, 135 include straight threads and are held rotationally fixed by a set screw 136 and are engaged by seal 137. Upper end 106 is internally threaded and may be called a box end, configuring it to couple housing 104 to upper segment 64 of string 50. The threads at housing upper end 106 and lower end 105 are tapered threads in this example.

Figure 3:
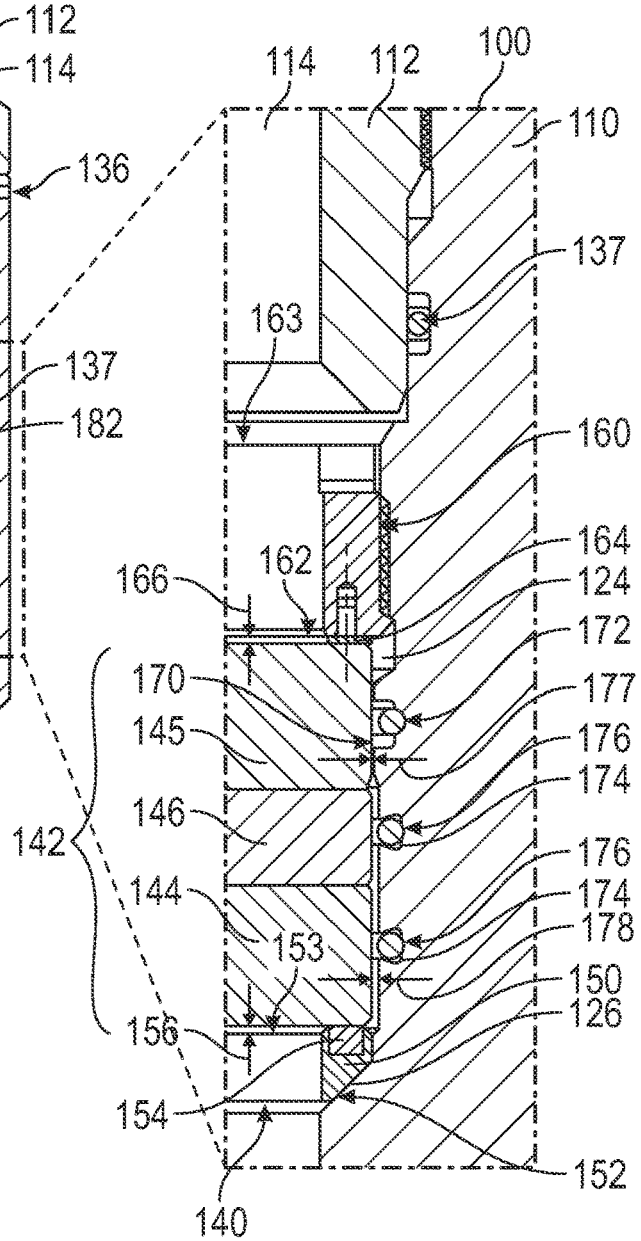
FIG. 3 shows an enlarged view of a portion of the flotation device of FIG. 2.

Referring now to FIG. 2 and FIG. 3, plug assembly 140 includes a shoulder ring 150 that supports breakable barrier 142 against housing shoulder 126 and a threaded annular retainer 160 that maintains the position of barrier 142 and ring 150 within counterbore 124 of chamber 114. Breakable barrier 142 includes a layered stack of tempered glass members. In this example, barrier 142 includes a first or control disk 144 at the bottom proximal ring 150, a second or seal disk 145 at the top proximal retainer 160, and a third or adjustment disk 146 positioned as an intermediate member between discs 144, 145. The members of plug assembly 140 are concentrically located along axis 108. Shoulder ring 150 is an annular member that includes a lower surface 152 resting on housing shoulder 126, an upper surface 153, and a plurality of packing spacers or feet 154 extending upward from the body of ring 150 through and beyond upper surface 153. Ring lower surface 152 and shoulder 126 on are complementarily tapered. Control disk 144 rests on feet 154, which maintain a gap, a non-zero distance 156 between disk 144 and the upper surface of ring 150. Ring 150 and feet 154 serve as a seat for breakable barrier 142. Threaded annular retainer 160 is threadedly received in counterbore 124 and includes a lower surface 162, an upper surface 163, and plurality of packing spacers or feet 164 extending downward from the body of retainer 160, through and beyond lower surface 162. Feet 164 are positioned against seal disk 145 to maintain a gap, a non-zero distance 166 between disk 145 and lower surface of retainer 160. Feet 154, 164 protect the breakable barrier 142 (e.g. control disk 144 and seal disk 145, respectively) from axial impact damage during the transportation and run-in procedures in the well. In some embodiments, a disk is added to assist or to replace feet 154 or feet 164 to maintain distance 156, 166 between ring 150 and control disk 144 or between retainer 160 and seal disk 145, respectively. Feet 154, feet 164, or the added disk(s) include a polymer, an elastomer, a phenolic, or a dissolvable material in some examples. In various embodiments, shoulder ring 150 or retainer 160 includes material selected from among this group: dissolvable material, non-dissolvable material, resilient material, and rigid material. In some embodiments, ring 150 or retainer 160 includes an aluminum body. In some embodiments, ring 150 or retainer 160 includes a polymer, an elastomer, or a phenolic. The use of a dissolvable material provides improved access for a fluid or a tool to pass through housing 140 after barrier 142 has been intentionally destroyed and travels away. As examples, the improved access results from achieving a larger cross-sectional area or smother pathway through housing 140. Defining chamber 114 broadly, it may be said that the walls of chamber 114 become smoother or larger in some embodiments after ring 150 or retainer 160 dissolves or breaks apart and is carried away.

The distances 156, 166 above and below breakable barrier 142 may be implemented by the inclusion of the feet 154, 164 as described. In addition, during installation, a technique for installing threaded retainer 160 may be used to establish or to increase distance 156 or distance 166. After ring 150 and after the discs of breakable barrier 142 are installed in housing member 110, retainer 160 is threaded into member 110. Retainer 160 is rotated until the feet 164 are firmly engaged with the upper glass member, e.g. disk 145, and then retainer 160 is "backed-off" (i.e., rotated in the opposite direction) to lessen or loosen the engagement between feet 164 and disk 145. In some examples, retainer 160 is backed-off by one-half of a turn, e.g., 180 degrees. In some embodiments, a disk 144, 145, 146 or breakable barrier 142 is free to rotate about axis 108 and to flex in the axial direction after plug assembly 140, including retainer 160, is installed within chamber 114.

Referring still to FIG. 3, the wall of counterbore 124 includes a groove adjacent the perimeter of each disk 144, 145, 146, and an O-ring or other resilient member is disposed in each groove, coupled between the tubular housing 104 and breakable barrier 142. For example, a groove 170 and an annular seal, which in this example is an O-ring 172, are axially adjacent to seal disk 145, positioned and configured to prevent fluid transfer between up-hole portion 116 and downhole portion 118 of chamber 114. O-ring seal 172 sealingly engages disk 145 to maintain a pressure differential between chamber portions 116, 118 when a column of liquid is added to chamber portion 116 and to the string's upper tubular segment 60 (FIG. 1) while chamber portion 118 and lower tubular segment 64 contain gas. O-ring 172 also protects seal disk 145 from radial impact damage during transportation and during run-in procedures, performing as an annular cushion. A pair that includes a groove 174 and an annular member or seal, which in this example is an O-ring 176, is positioned axially adjacent to each disk 144, 146, to protect the discs from radial impact damage, to perform as annular cushions. Grooves 174, in FIG. 3, are dovetail grooves in this example.

Figure 4:
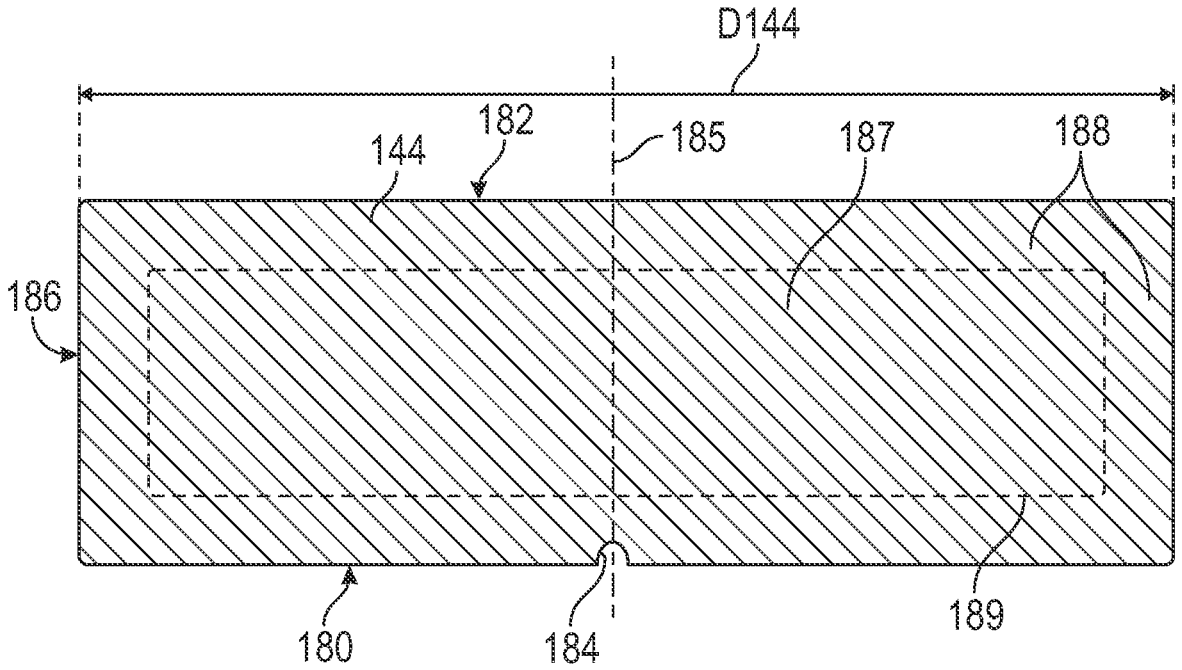
FIG. 4 shows a cross-section view of the control disk of FIG. 2.

Referring again to FIG. 2, control disk 144 includes a lower surface or face 180, an upper surface or face 182 axially spaced-apart from face 180, and a strength-reducing surface feature 184 in lower face 180. Lower face 180 and feature 184 face away from discs 145, 146. When device 100 is installed in a string, as shown in FIG. 1, lower face 180 and feature 184 face toward the downhole portion 118 of chamber 114 and away from the up-hole portion 116, in which an elevated pressure may be applied using a liquid. FIG. 4 shows a closer, cross-section view of the tempered glass of control disk 144. Upper face 182 is spaced-apart from face 180 along a central axis 185, and an outer, circumferential surface 186 extends about axis 185 between faces 180, 182. Disk 144 and its outer surface 186 are characterized by a diameter D144. Due to the nature of tempered glass as a result of a quench heat treatment, an outer portion or compression zone 188 of disk, which cools first, exists in a state of compressive stress and a central portion or tension zone 187 of disk 144 exists in a state of tensile stress. FIG. 4 is representative of disk 144 at least while it experiences equal pressure on all outer surfaces. For convenience of discussion, a dashed boundary line 189 in FIG. 4 suggests a generalized boundary between zones 187, 188. Compression zone 188 includes the outer surface of disk 144, which includes faces 180, 182, and circumferential surface 186. Compression zone 188 extends inward toward or to tension zone 187. The compressive stress or "pre-stress" in zone 188, at least as it exists at faces 180, 182, may be called residual surface compression. Seal disk 145 and spacer disk 146, each including tempered glass, also include a tension zone like tension zone 187 and a compression zone like compression zone 188.

Figure 5:
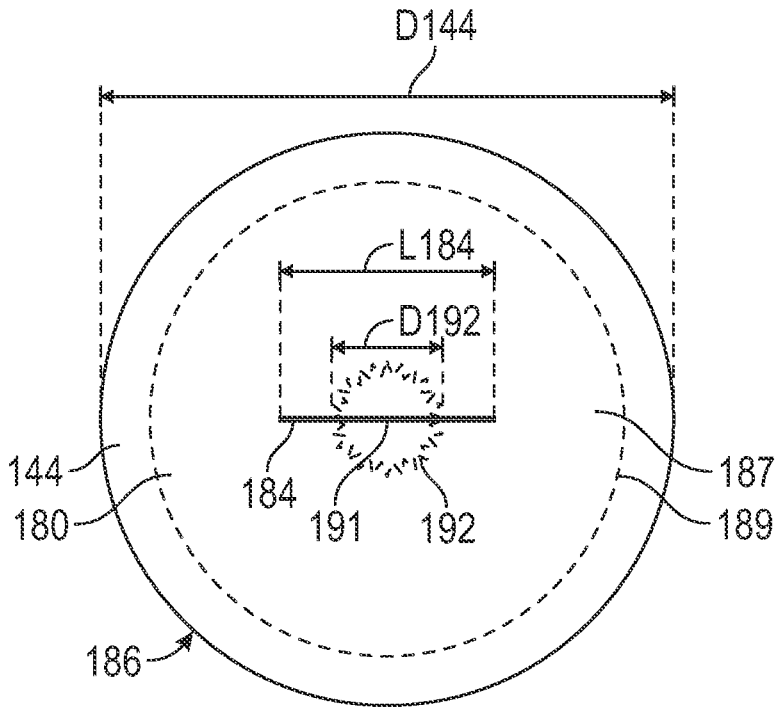
FIG. 5 shows a bottom view of the control glass disk of FIG. 2 with a strength-reducing surface feature in accordance with principles described herein.

Referring now to the bottom view of control disk 144 in FIG. 5, lower face 180 includes a center 191 on axis 185 and a stress-susceptible region 192 located around and including center 191. Center 191 is aligned with axis 108 in FIG. 2. Due to its location about center 191 at least in some embodiments, stress-susceptible region 192 will also be called a central region. For a circular disk, central region 192 is characterized by a diameter D192. The region 192, e.g. diameter D192, is estimated or selected based on a prediction for the distribution of mechanically induced stresses on lower surface 180, stresses that would be caused by pressures applied from upper surface 182. For example, as a burst pressure is applied to plug assembly 140 from chamber uphole portion 116, a net positive tensile stress develops within region 192 of lower surface 180. An estimate or prediction of the location of net positive tensile stress in lower surface 180 may be used to define the central region's diameter D192. In general, diameter D192 corresponds to a maximum boundary, an average size, or a minimum boundary of the anticipated tensile stress. In some embodiments, a size for central region 192, e.g. diameter D192, may be estimated or selected based on a rule-of-practice (such as a percentage of the disk diameter D144), or another factor. For example in some embodiments, central region is a generally circular region having a diameter D192 that is 75% of the disk diameter D144. The central region may have a smaller diameter and may be, for example, 50% of D144 in other embodiments. In various embodiments, central region 192 is non-circular or lacks a readily distinguished shape. In general, as a result of heat treating or the curved nature of the radially outer surface 186, central region 192 encompasses a portion of disk 144 that is substantially more susceptible to puncture or rupture damage than is a region that is radially outside region 192.

Strength-reducing surface feature 184 intersects central region 192, contacting or extending through region 192. In FIG. 5, feature 184 also intersects center 191. A strength-reducing surface feature that does not extend through a central region is contemplated for some embodiments. In at least some of these embodiments, the strength-reducing surface feature extends across a portion of the estimated tension zone 187, as feature 184 does. Feature 184 is characterized by an extent or length L184. In this embodiment, feature 184 is a linear recess, abrasion, or scratch. In general, feature 184 is representative of a variety of features and may be selected from the group consisting of a recess, a scratch, an abrasion, an impact mark, an etching, a surface irregularity, and a surface coating, as examples. In some embodiments, feature 184 comprises multiple recesses, scratches, abrasions, impact marks, etchings, a surface irregularities, or surface coatings. In some embodiments, the strength-reducing surface feature 184 is a ceramic coating. Some embodiments feature 184 includes multiple of these types of features. Although feature 184 is shown as having a straight, very elongate, generally one-dimensional shape on face 180 (without considering its depth into disk 144); in some embodiments, feature 184 has a two-dimensional shape on face 180, including curves and cross-hatch patterns, as examples. In some embodiments, the strength-reducing surface feature covers a surface region or regions on face 180. The strength-reducing surface feature is created by any known method. For example, in some embodiments, the strength-reducing surface feature is created by a method selected from the group consisting of grinding, cutting, etching, grit blasting, abrading, and coating. In general, strength-reducing surface feature 184 is a stress concentrator for the disk where it is located.

Continuing to reference FIG. 5, strength-reducing surface feature 184 weakens face 180 and therefore weakens the resistance of control disk 144 to impact, pressure, or another source of stress that may be applied to upper face 182. In general, the size of feature 184 (e.g. length L184 and depth) is selected using an engineering criterion or another rule-of-practice based on the disk diameter D144, the size of central region 192, or the size of a tensile stress region within the glass disk 144, as examples. The criterion or a rule-of-practice for length L184, for example, may be based on a percentage of disk diameter D144, central region diameter D192, an estimated diameter of tensile stress region. In some embodiments, length L184 is selected to be larger than diameter D192 of central region 192, as shown in FIG. 5. In some examples, length L184 is between 105 and 110%; inclusive, of the diameter D144; between 110 and 120%, inclusive, of the diameter D144; is between 115 and 140%, inclusive, of the diameter D144; or is between 140 and 160%, inclusive. The length L184 of strength-reducing surface feature 184 may be selected to be smaller than diameter D192 of central region 192. In some examples, length L184 is between 5 and 10%; inclusive, of the diameter D144; between 10 and 20%, inclusive, of the diameter D144; is between 15 and 40%, inclusive, of the diameter D144; or is between 40 and 60%, inclusive. In general, the depth of feature 184 extends a selected distance into the compression zone 186 of the tempered glass of disk 144 below surface 180 and does not extend into the tension zone 187 that lies deeper within disk 144.

Similar to lower face 180, upper face 182 of disk 144 and all faces of all disks includes a center and a central region. In some embodiments, upper face 182 or any face of any disk may include a strength-reducing surface feature having any of the characteristics described herein for a strength-reducing surface feature such as feature 184. The strength-reducing surface feature in the upper face or the faces of other disks may improve the precision of the control disk's response to a rising pressure, such as a pressure that is intended to cause rupture. In some embodiments, having strength-reducing surface features in both a first and a second face serves to make the control disk reversible, able to be inserted in either of two directions, so that either face may be used as the upper or the lower face, helping to insure satisfactory assembly of the flotation device.

Referring again to FIG. 3, the clearance distances between the various disks 144, 145, 146 and the inner wall of lower housing member 110 influence the performance of flotation device 100. If the annular clearance between the lower disks 144, 146 and housing member 110 is too small, breakable barrier 142 may "bridge" and stay together after it breaks as a result of experiencing a burst pressure. If the annular clearance between the upper, seal disk 145 and housing member 110 is too large, fluid may leak past disk 145 and its seal 172. To account for these issues, an annular first clearance 177 is established around seal disk 145, and an annular second clearance 178 is established is established for seal disk control disk 144 and around spacer disk 146. Clearance 178 extends for an axial length appropriate for the thickness of these disks. Second clearance 178 is larger than first clearance 177. In some embodiments, second clearance 178 extends axially alongside a lower portion of seal disk 145. Second clearance 178 provides space for disks to flex, allowing the outer perimeter of the disks to expand as the center of the disks is pushed downward when an elevated pressure in the chamber's uphole portion 116 acts on the disks. Without a sufficient clearance 178 around disks 145, 147, the expansion of the lower surface of the disks during elevated uphole pressure could cause the disks to press against the wall of housing 104, potentially wedging the disks in-place even after experiencing a burst pressure that breaks a disk or multiple disks. In an exemplary embodiment, the diameters of disks 144, 145, 146 are 5.40 inches (137 mm); their thicknesses are 1.000, 0.375, and 0.741 (25.4, 9.5, and 18.8 mm) respectively, the circumferentially-extending first clearance 177 is between 0.008" (0.20 mm) minimum and 0.013" (0.33 mm) maximum, and the circumferentially-extending second clearance 178 is between 0.040" (1.02 mm) minimum and 0.045" (1.14 mm) maximum. Other values and relative sizes for each of these parameters are contemplated. For example, in some embodiments, the relative thicknesses of disks 144, 145, 146 differ from the stated example.

In general, when a pressure differential, is applied to a plate or disk of glass, stresses and strains or shape distortions develop. For example, with a higher pressure on an upper face and a lower pressure on a lower face, the net pressure or load on the upper face causes a compressive stress on the upper face and causes a tensile or stretching stress on the lower face. As explained above with respect to FIG. 4, for tempered glass in an isobaric environment (i.e., free of any pressure differential), outer faces (e.g., upper and lower faces 180, 182) are initially in a state of compression, called a residual surface compression. As a load is applied to the upper face, the upper face experiences increased compressive stress or compression, and the compressive stress or compression in the lower face decreases. As the load increases toward a predetermined burst value, for example, the stress exerted by the load neutralizes the compression in the lower face. As the load increases still further, the force exerted by the load develops a net positive tensile stress on the lower face. Thus, for tempered glass, an external load applied at a first surface (e.g. upper face) must overcome the pre-stress or residual surface compression proximal and in a second surface (e.g., lower face) of the glass before a net positive tensile stress can develop in or on the second surface. In this manner, sufficient pressure loading on the upper face can create a tensile stress on the lower face. In general, the increased compression in the upper face is not detrimental, but the development of tension in the lower face increases the susceptibility of the tempered glass to failure and can ultimately cause the glass to fail.

In general, the residual surface compression (RSC) for tempered glass is equal to or greater than 10 k psi (i.e., 10,000 pounds per square inch) (68,900 kPa). In various embodiments, the discs of breakable barrier 142 (e.g. the individual discs 144, 145, 146 of FIGS. 1-5) are made with glass having an RSC equal to or greater than 10 k psi. In some embodiments, a disk or discs of breakable barrier 142 are made with glass having a higher-level of tempering, e.g., having an RSC equal to or greater than 20 k psi (138,000 kPa). In some embodiments, a disk or disks of breakable barrier 142 are made with glass having a still higher-level of tempering, e.g., having an RSC equal to or greater than 30 k psi (207,000 kPa). Some of these embodiments include a disk or discs having an RSC value within a of range 20 k psi to 30 k psi. Some of these embodiments include a disk or discs having an RSC value within a of range 28 k psi to 35 k psi. As used herein and in the claims, values and ranges of values for RSC selected for or attributed to a glass disk of breakable barrier 142 may also be called the predetermined residual surface compression or the design value of residual surface compression.

Referring again to FIGS. 1 and 2, breakable barrier 142 is configured to resist pressure in liquid 58 in the upper tubular segment 60 of string 50 and to fail when the pressure of the liquid is increased to exceed a predetermined burst pressure of the breakable barrier. The failing of breakable barrier 142 is to be performed while the lower portion of string 50 is gas-filled, including lower tubular segment 64 and downhole portion 118 of chamber 114 in housing 104. Thus, discussions about the pressure of liquid 58, including burst pressure, in upper tubular segment 60 and the chamber's up-hole portion 116 refer to pressure that acts against the strength of breakable barrier 142 and against a gas or liquid pressure in the lower portion of string 50. This convention regarding pressure acting against a face of a glass member also pertains to the claims that follow below. Failure of barrier 142 results when the control disks is stressed to the point of breaking with failure of any remaining disks occurring immediately after failure of the control disk as the pressure load is redistributed. The strength, e.g., resistance to failure, of a glass disk is directly related to a disk's residual surface compression. For example, the amount of pressure that a disk can withstand (e.g., a value less than its burst pressure) is directly proportional to the disk's residual surface compression. The strength, e.g., resistance to failure, of breakable barrier 142 is directly related to the residual surface compression values of disk 144. In general, the rupture strength of the breakable barrier 142 is directly proportional to the RSC of control disk 144 and the severity of the strength-reducing surface feature 184. A higher RSC for disk 144 increases the strength the disk and the strength of breakable barrier 142 as a whole, meaning that disk 144 and the barrier are able to withstand higher pressure from liquid 58 before breaking, as compared to a barrier having an otherwise-similar disk with a lower value of RSC. Higher strength, e.g., resistance to failure, of disk 144 corresponds to a higher burst pressure for barrier 142.

In addition to RSC, other factors, such as thickness and diameter, also influence the strength and the burst pressure of a disk or a stack of discs. The strength of control disk 144 and therefore the burst pressure of flotation device 100 are adversely influenced by the addition of a strength-reducing surface feature 184 on the lower face 180. Lower face 180 is selected for feature 184 because face 180 is pointed away from upper tubular segment 60 where an elevated pressure in liquid 58 may be applied, making lower face 180 susceptible to the development of a net positive tensile stress. Feature 184 acts as a stress concentrator for disk 144, predisposing it to fail under a predictable or predetermined level of net positive tensile stress. Strength-reducing surface feature 184 is configured (e.g., a size and design are selected) to cause glass disk 144, to fail before the other glass members of barrier 142 fail. The failure of disk 144 will precipitate the failure of discs 145, 146, destroying breakable barrier 142, which is beneficial when flotation device 100 is operated as described herein. Thus, disk 144 and its feature 184 govern or fine-tune the level of pressure at which the several discs of barrier 142 will break, establishing the burst pressure for breakable barrier 142. In the current embodiment, disks 145, 146 are thinner than control disk 144. During operation when an operating pressure is applied, or a rupture pressure is achieved above breakable barrier 142, the stress levels in the disks 145, 146 will be less than the stress levels in the thicker control disk 144 until disk 144 ruptures at which point the stresses in the remaining disks 145, 146 spike, causing them to rupture. To avoid premature breakage, disks 145, 146 are configure to have RSC values that are greater than the stress levels experienced by these disks during operation, for example, stress levels induced by the operating pressure or by elevated pressure leading to the rupture pressure. Higher levels of RSC for any disk will cause the disk to break into smaller fragments if and when it ultimately ruptures.

Referring to FIG. 2, in general, to cause the failure of control disk 144, which will cause failure of barrier 142, the pressure in the up-hole portion 116 of chamber 114 is increased until sufficient tensile stress is applied to lower face 180 to negate and ultimately to exceed the predetermined residual surface compression. When the tensile stress applied to face 180 is greater than the RSC, face 180 experiences a net positive tensile stress. For failure of disk 144, the pressure in the up-hole portion 116 is to be sufficient to develop in lower face 180 a net positive tensile stress that is more than the tensile strength of that face. The minimum pressure that would cause failure of disk 144 or barrier 142 is the burst pressure. The strength-reducing surface feature 184 in face 180 is configured to cause disk 144 and barrier 142 to fail at a predetermined burst pressure that may be selected for a particular embodiment based on the structure of feature 184. In various embodiments, The inclusion of feature 184 causes barrier 142 to fail with greater reliability or preciseness when exposed to the predetermined burst pressure that would a disk or stack of discs that does not include a strength-reducing surface feature.

In some embodiments, breakable barrier 142 is configured to burst when pressure in the up-hole portion 116 of chamber 114 is 5780 psi (39,900 kPa) or greater, and thus, the burst pressure is 5780 psi. Some embodiments, the burst pressure is 6,250 psi (43,100 kPa). Other values are also contemplated for the burst pressure. In some embodiments, disk 144 is configured to fail when the pressure in the up-hole portion 116 of the chamber is of a magnitude that creates the tensile stress in the first glass member that exceeds the predetermined residual surface compression by 5% of the residual surface compression or more. This is equivalent to saying that disk 144 is configured to fail when disk 144 has a net positive tensile stress that has a magnitude equal to 5% of the residual surface compression or more. The tensile stress that causes failure or that occurs when a disk fails may be called the failure tensile stress of the glass member. In some embodiments, failure tensile stress for disk 144 is established or predetermined to be a value selected from within a group of ranges that include: between 2 and 5% more than the RSC inclusive, between 2 and 10% more than the RSC inclusive, between 2 and 15% more than the RSC inclusive, between 5 and 8% more than the RSC inclusive, and between 5 and 15% more than the RSC inclusive, as examples. In some embodiments, failure tensile stress for disk 144 is established or predetermined to be within another range of values spanned by those values stated above. The net positive tensile stress at failure is similarly defined for these embodiments.

In some embodiments, disk 144 is configured to fail when the pressure in the up-hole portion 116 of the chamber is of a magnitude that creates a tensile stress (i.e., the failure tensile stress) in disk 144 that exceeds the predetermined residual surface compression by 2,000 psi (13,790 kPa) or more. This is equivalent to saying that disk 144 is configured to fail when disk 144 has a net positive tensile stress of 2,000 psi (13,790 kPa) or more. In some embodiments, the failure tensile stress of disk 144 exceeds the predetermined residual surface compression by 2,000 psi (13,790 kPa) or less. In various embodiments, the failure tensile stress for disk 144 is established or predetermined to exceed the RSC by a value selected from within a group of ranges that include: between 400 and 1,000 psi inclusive, between 400 and 3,000 psi inclusive, between 1,000 and 1,600 psi inclusive, and between 1,000 and 3,000 psi inclusive, and in excess of 3,000 psi, as examples. The net positive tensile stress at failure is similarly defined for these embodiments.

Another Exemplary Embodiment

Figures 6, 7:
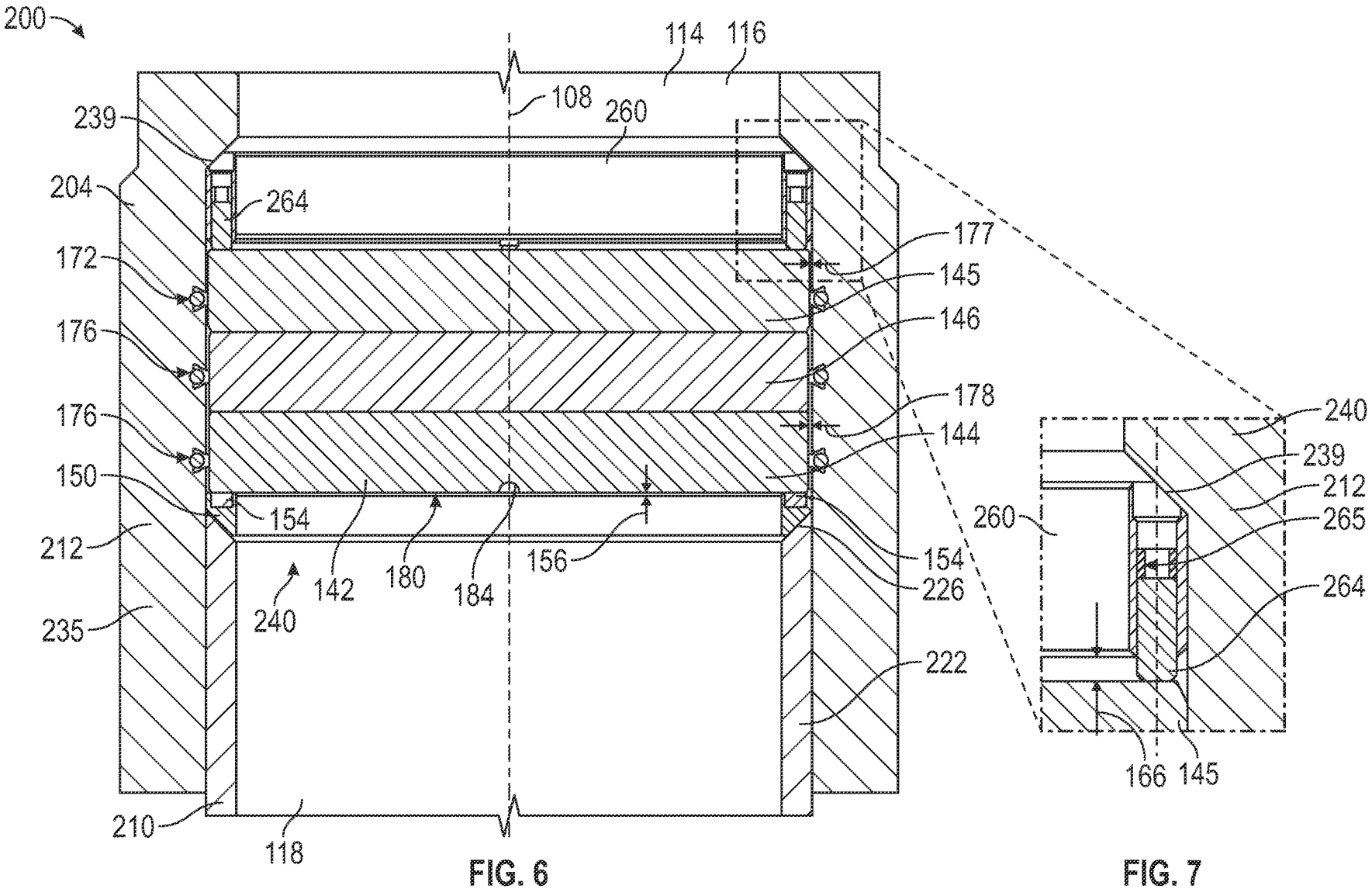
FIG. 6 shows another embodiment of a flotation device having a plug assembly with discs of tempered glass, in accordance with principles described herein.
FIG. 7 shows an enlarged view of a portion of the flotation device of FIG. 6.

Referring to FIG. 6 and FIG. 7, another embodiment of a downhole subassembly designed for downhole operation consistent with the present disclosure is a flotation device 200. Flotation device 200 is configured to be installed within a string, such as completion string 50 (FIG. 1) as an alternative to flotation device 100. Flotation device 200 includes an elongate tubular housing 204 extending along a central or longitudinal axis 108 and includes a plug assembly 240 located within housing 204 and having a breakable barrier 142. Breakable barrier 142 is configured as previously described and may be varied in accordance with principles described herein. Flotation device 200 and breakable barrier 142 perform as previously described regarding flotation device 100 and its breakable barrier 142.

Housing 204 includes a pair of elongate, axially aligned tubular members 210, 212. A tubular, lower housing member 210 is threadedly coupled to a tubular, upper housing member 212. A chamber 114 extends through members 210, 212. Plug assembly 240 and its breakable barrier 142 are positioned in a chamber 114, dividing chamber 114 into an up-hole portion 116 and a downhole portion 118. Within chamber 114, an annular first clearance 177 exists between upper, seal disk 145 and housing member 210 and an annular second clearance 178 exists between lower disks 144, 146 and housing member 210. These clearances are similar to the clearances described for flotation device 100. For example, in flotation device 200, the second clearance 178 is larger than first clearance 177. When flotation device 200 is installed in a string, such as string 50 (FIG. 1), breakable barrier 142 separates the lower tubular segment 64 from the upper tubular segment 60 before the breakable barrier is caused to fail. Referring still to FIG. 6, upper end 222 of lower housing member 210 includes a tapered, upward facing shoulder 226, which may be called a housing shoulder. Upper housing member 212 includes an internally threaded lower end 235 configured to couple around the upper end 222 of housing member 210. In some embodiments, the coupled ends 222, 235 include straight threads and are held rotationally fixed by a set screw and engaged by an annular seal. Housing member 212 at lower end 235 includes a tapered, downward facing internal shoulder 239, which also may be called a housing shoulder. Plug assembly 240 rests within upper housing member 212, between shoulders 226, 239, being positioned substantially outside lower housing member 210.

Plug assembly 240 includes a shoulder ring 150 that supports breakable barrier 142 against housing shoulder 226 and an annular retainer 260 that maintains the position of barrier 142 and ring 150 within chamber 114, held against shoulder 239. As previously described, breakable barrier 142 includes a layered stack of tempered glass members, which in this example includes a first or control disk 144 proximal ring 150, a second or seal disk 145 proximal retainer 260, and a third or adjustment disk 146 positioned between discs 144, 145. Tempered glass discs 144, 145, 146 are configured as previously described and may be varied in accordance with principles described herein. For example, control disk 144 includes a strength-reducing surface feature 184 on a lower face 180. Shoulder ring 150 is configured as previously described and may be varied in accordance with principles described herein. For example, shoulder ring 150 includes a tapered lower surface resting on housing shoulder 226, and a plurality of packing spacers or feet 154 extending upward and supporting control disk 144, causing it to be spaced apart from the body of ring 150. Ring 150 and feet 154 serve as a seat for breakable barrier 142.

Referring to FIG. 6 and FIG. 7, threaded annular retainer 260 is slidingly received in chamber 114 within upper housing member 212 at shoulder 239. Retainer 260 includes plurality of packing spacers or feet 264 extending axially, downward from the body of retainer 260. The axial position of each foot 264 relative to the body of retainer 260 is adjustable by a set screw 265, which is axially movable in this embodiment. Feet 154 maintain a non-zero distance 156 between disk 144 and the upper surface of ring 150. Feet 264 are positioned against seal disk 145 to maintain a gap, a non-zero distance 166 between disk 145 and the lower surface 162 of retainer 260. Feet 154, 264 protect the breakable barrier 142 (e.g. control disk 144 and seal disk 145, respectively) from axial impact damage during the transportation and run-in procedures in the well. Feet 154, 264 may be varied or replaced in accordance with principles described herein. The material for shoulder ring 150 may be selected in accordance with principles described herein. The material for retainer 260 may be selected according to the various embodiments disclosed herein for retainer 160.

Referring still to FIG. 6, an annular seal 172 sealingly engages seal disk 145 to prevent fluid transfer and to provide a pressure barrier between up-hole portion 116 and downhole portion 118 of chamber 114. Seal 172 also protects seal disk 145 from radial impact damage during transportation and during run-in procedures, to perform as an annular cushion. A separate annular member or seal 176 is positioned axially adjacent to each disk 144, 146, to protect the discs from radial impact damage, to perform as annular cushions.

Another Exemplary Embodiment

Figure 9:
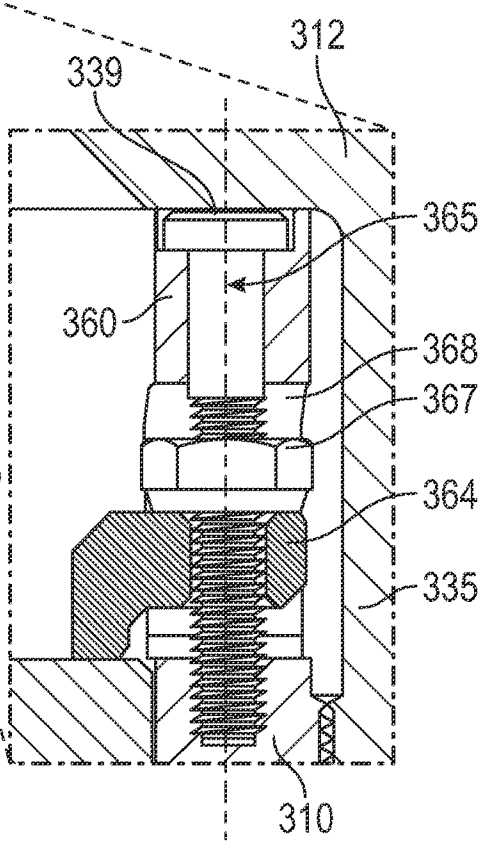
FIG. 9 shows an enlarged view of a portion of the flotation device of FIG. 8.
Figure 8:
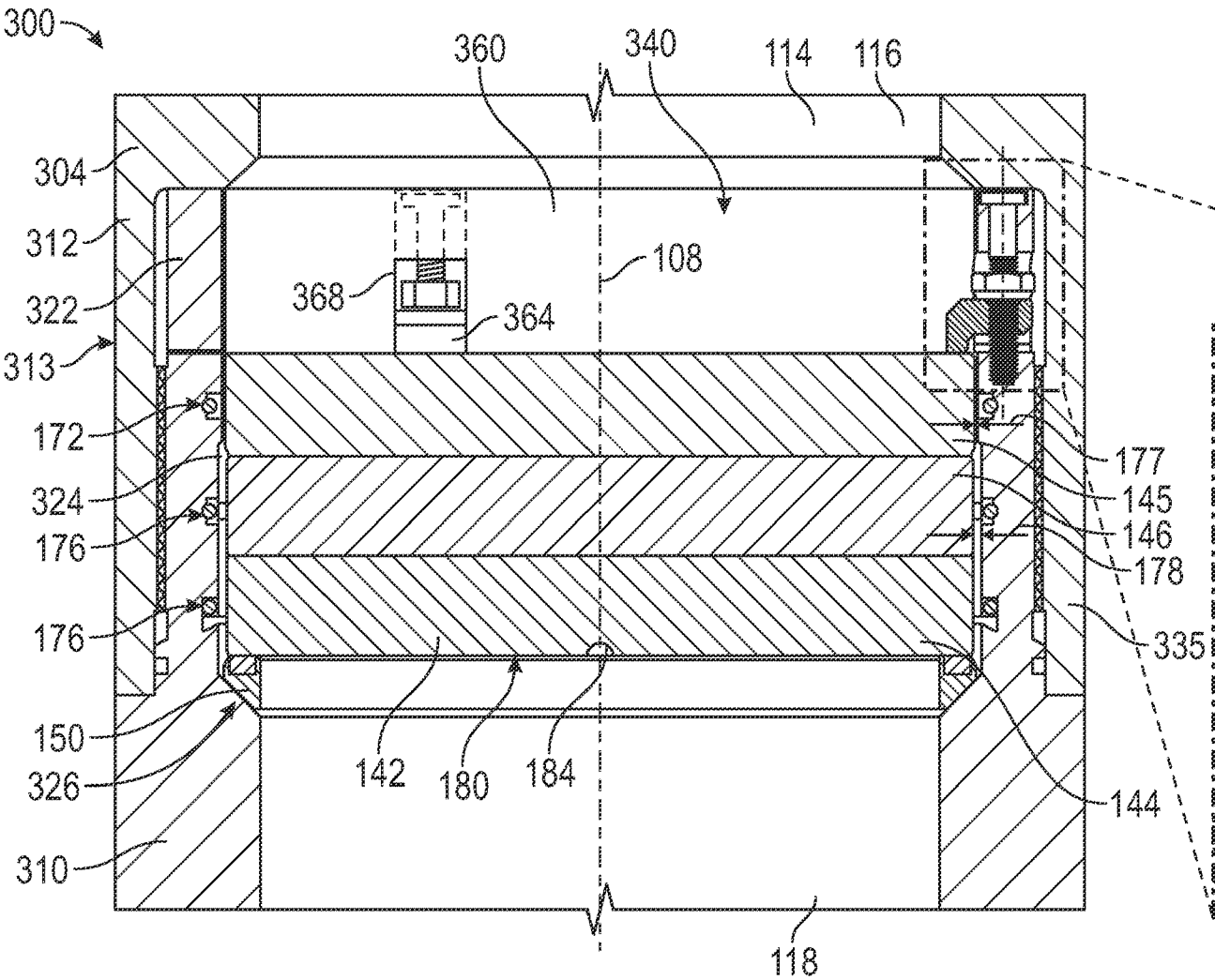
FIG. 8 shows another embodiment of the flotation device having a plug assembly with discs of tempered glass, in accordance with principles described herein.

Referring to FIG. 8 and FIG. 9, another embodiment of a downhole subassembly designed for downhole operation consistent with the present disclosure is a flotation device 300. Flotation device 300 is configured to be installed within a string, such as completion string 50 (FIG. 1) as an alternative to flotation device 100. Flotation device 300 includes an elongate tubular housing 304 extending along a central or longitudinal axis 108 and includes a plug assembly 340 located within housing 304 and having a breakable barrier 142. Breakable barrier 142 is configured as previously described and may be varied in accordance with principles described herein. Flotation device 300 and breakable barrier 142 perform as previously described regarding flotation devices 100, 200 and their breakable barriers 142.

Housing 304 includes a pair of elongate, axially aligned tubular members 310, 312. A tubular, lower housing member 310 is threadedly coupled to a tubular, upper housing member 312. Housing members 310, 312 include an outer surface 313 having a uniform diameter, at least in the region where members 310, 312 engage. A chamber 114 extends through housing members 310, 312. Plug assembly 340 and its breakable barrier 142 are positioned in a chamber 114, dividing chamber 114 into an up-hole portion 116 and a downhole portion 118. Within chamber 114, an annular first clearance 177 exists between upper, seal disk 145 and housing member 310 and an annular second clearance 178 exists between lower disks 144, 146 and housing member 310. These clearances are similar to the clearances described for flotation device 100. For example, in flotation device 300, the second clearance 178 is larger than first clearance 177. When flotation device 300 is installed in a string, such as string 50 (FIG. 1), breakable barrier 142 separates the lower tubular segment 64 from the upper tubular segment 60 before the breakable barrier is caused to fail. Referring still to FIG. 8, upper end 322 of lower housing member 310 includes a counterbore 324 that creates a tapered, upward facing shoulder 326, which may be called a housing shoulder. Upper housing member 312 includes an internally threaded lower end 335 configured to couple around the upper end 322 of housing member 310. In some embodiments, the coupled ends 322, 335 include straight threads and are held rotationally fixed by a set screw and engaged by an annular seal.

Plug assembly 340 includes a shoulder ring 150 that supports breakable barrier 142 against housing shoulder 326. As previously described, breakable barrier 142 includes a layered stack of tempered glass members, which in this example includes a first or control disk 144 proximal ring 150, a second or seal disk 145, and a third or adjustment disk 146 positioned between discs 144, 145. Tempered glass discs 144, 145, 146 are configured as previously described and may be varied in accordance with principles described herein. For example, control disk 144 includes a strength-reducing surface feature 184 on a lower face 180. Shoulder ring 150 is configured as previously described and may be varied in accordance with principles described herein.

Referring to FIG. 8 and FIG. 9, plug assembly 340 is held within lower housing member 310 by a clamping device 360 that is incorporated into lower housing member 310. Device 360 includes multiple, circumferentially spaced slots or apertures 368, extending through the wall of the member 310. Device 360 further includes multiple adjustable clamp members or feet 364, each foot coupled within an aperture 368 by an adjustable fastener, which in this example includes a screw 365 and a nut 364. Screws 365 are threaded axially within the wall of housing member 310 at upper end 322, extending through the apertures 368. Feet 346 extend radially inward from apertures 368 and extend axially downward to contact and restrain breakable barrier 142. Flotation device 300 lacks a separate retainer, but configured as described, clamping device 360 coupled within housing member 310 forms an annular retainer for plug assembly 340, including breakable barrier 142. Feet 364 may include a polymer or another material. The example of FIG. 8 includes three sets of apertures 368, each containing a foot 364 and a pair of fasteners 365, 364. Feet 326 are configured to slide axially within apertures 368 with the relative positions of feet 326 established by fasteners 365, 364.

Referring still to FIG. 8, an annular seal 172 sealingly engages seal disk 145 to prevent fluid transfer and to provide a pressure barrier between up-hole portion 116 and downhole portion 118 of chamber 114. Seal 172 also protects seal disk 145 from radial impact damage during transportation and during run-in procedures, performing as an annular cushion. A separate annular member or seal 176 is positioned axially adjacent to each disk 144, 146, to protect the discs from radial impact damage, to perform as annular cushions.

Another Exemplary Embodiment

Figure 10:
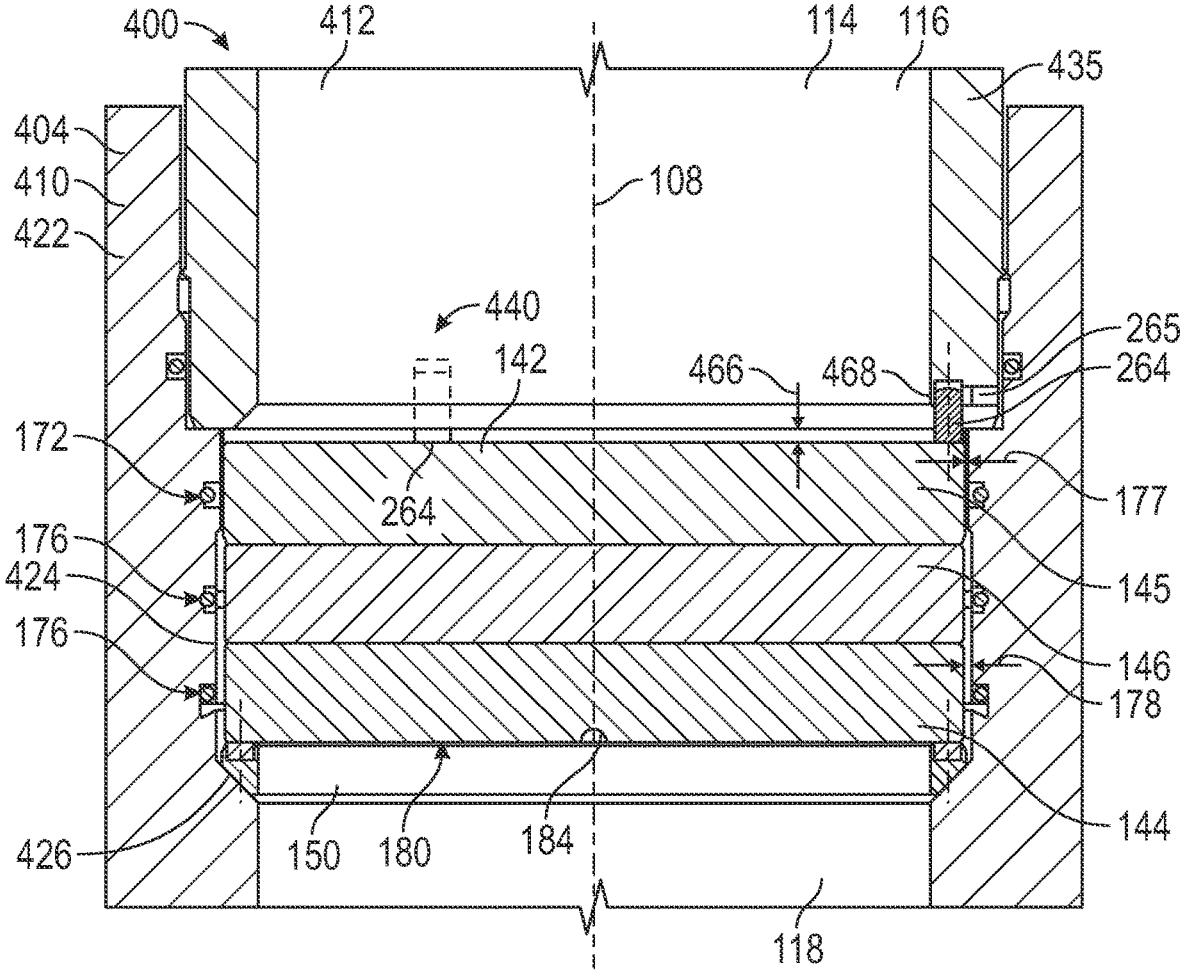
FIG. 10 shows another embodiment of a flotation device having a plug assembly with discs of tempered glass, in accordance with principles described herein.

Referring to FIG. 10, another embodiment of a downhole subassembly designed for downhole operation consistent with the present disclosure is a flotation device 400. Flotation device 400 is configured to be installed within a string, such as completion string 50 (FIG. 1) as an alternative to flotation device 100. Flotation device 400 includes an elongate tubular housing 404 extending along a central or longitudinal axis 108 and includes a plug assembly 440 located within housing 404 and having a breakable barrier 142. Breakable barrier 142 is configured as previously described and may be varied in accordance with principles described herein. Flotation device 400 and breakable barrier 142 perform as previously described regarding flotation devices 100, 200, 300 and their breakable barriers 142.

Housing 404 includes a pair of elongate, axially aligned tubular members 410, 412. A tubular, lower housing member 410 is threadedly coupled to a tubular, upper housing member 412. A chamber 114 extends through members 410, 412. Plug assembly 440 and its breakable barrier 142 are positioned in a chamber 114, dividing chamber 114 into an up-hole portion 116 and a downhole portion 118. Within chamber 114, an annular first clearance 177 exists between upper, seal disk 145 and housing member 410 and an annular second clearance 178 exists between lower disks 144, 146 and housing member 410. These clearances are similar to the clearances described for flotation device 100. For example, in flotation device 400, the second clearance 178 is larger than first clearance 177. When flotation device 400 is installed in a string, such as string 50 (FIG. 1), breakable barrier 142 separates the lower tubular segment 64 from the upper tubular segment 60 before the breakable barrier is caused to fail. Referring still to FIG. 10, upper end 422 of lower housing member 410 includes a counterbore 424 with a tapered, upward facing shoulder 426, which may be called a housing shoulder, and includes internal threads axially spaced from bore 424. So, upper end 422 of lower member 410 may be called a box end. Upper housing member 412 externally threaded lower end 435 configured as pin end to couple within the upper end 422 of housing member 410. Lower end 435 includes multiple, axially extending spaced holes 468, circumferentially spaced apart. In various embodiments, the coupled ends 422, 435 include straight threads and are held rotationally fixed by a set screw and engaged by an annular seal.

Plug assembly 440 includes a shoulder ring 150 that supports breakable barrier 142 against housing shoulder 426 and multiple packing spacers or feet 264, each foot 264 extending downward from within a hole 468 in the upper end 422 of housing member 410 and held at a selected axial location by a set screw 265. Upper end 422 and feet 264 are configured as a retainer to maintain the position of barrier 142 and ring 150 within counterbore 424 of chamber 114, held against shoulder 426. Feet 264 maintain a gap, a non-zero distance 466 between upper end 422 and breakable barrier 142. As previously described, breakable barrier 142 includes a layered stack of tempered glass members, which in this example includes a first or control disk 144 proximal ring 150, a second or seal disk 145, and a third or adjustment disk 146 positioned between discs 144, 145. Tempered glass discs 144, 145, 146 are configured as previously described and may be varied in accordance with principles described herein. For example, control disk 144 includes a strength-reducing surface feature 184 on a lower face 180. Shoulder ring 150 is configured as previously described and may be varied in accordance with principles described herein.

Referring still to FIG. 10, an annular seal 172 sealingly engages seal disk 145 to prevent fluid transfer and to provide a pressure barrier between up-hole portion 116 and down-hole portion 118 of chamber 114. Seal 172 also protects seal disk 145 from radial impact damage during transportation and during run-in procedures, performing as an annular cushion. A separate annular member or seal 176 is positioned axially adjacent to each disk 144, 146, to protect the discs from radial impact damage, to perform as annular cushions.

ADDITIONAL INFORMATION

Various embodiments disclosed herein included a breakable barrier 142 having a layered stack of three tempered glass members. Some other embodiments based on these examples include additional discs such as additional adjustment discs 146, for example. Some embodiments include only a control disk 144 and a seal disk 145 or only a control disk 144, with the axial spacing between ring 150 and retainer 160 adjusted accordingly. In embodiments in which the breakable barrier includes only the control disk 144, a seal member sealingly engages the control disk 144 and is also positioned to perform as an annular cushion. Some embodiments in accordance with principles described herein, include a strength-reducing surface feature on a face of a disk; wherein the strength-reducing surface feature does not intersect the center of the face. In some of these embodiments, the strength-reducing surface feature does not intersect the central region of the face. Some of these embodiments lack any strength-reducing surface feature that extends through the center of the face. Some of these embodiments lack any strength-reducing surface feature that extends through the central region of the face.

Various embodiments described herein include a tapered housing shoulder in a lower housing member or in an upper housing member for a flotation device and includes a corresponding tapered surface in a plug assembly (e.g., a ring lower surface 152 or a seat or ring 150) that is engagable with the tapered housing shoulder or shoulders. Some other embodiments in accordance with principles described herein, instead include a radially extending housing shoulder on a lower housing member or on an upper housing member in place of the tapered housing shoulder, and the corresponding surface of the plug assembly likewise, extends radially. For example, in some embodiments, a glass-receiving seat or ring that replaces seat or ring 150 has a radially extending surface to engage a radial shoulder of a lower housing member. In some embodiments, a glass-receiving seat or ring that replaces ring 150 is configured to threadedly engage a housing member.

Although various embodiments were described as including feet 154, 164, 264, as examples, some embodiments lack any feet between the disks of breakable barrier 142 and the seat or ring 150 or lack any feet between the disks of breakable barrier 142 and retainer 160, 260 or a housing member. In some of these embodiments, a gap, a non-zero distance is maintained between breakable barrier 142 and ring 150 or a housing member 110, 112 by another configuration, such as a spacing achieved by a pair of shoulders in housing members 110, 112 for example.

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatuses, and processes described herein are possible and are within the scope of the disclosure. Accordingly, the scope of protection is not limited to the embodiments described herein, but is only limited by the claims that follow, the scope of which shall include all equivalents of the subject matter of the claims.

What is claimed is:

1. A downhole subassembly, comprising:

a housing having a central axis and comprising:

a first end configured to connect to a first tubular;

a second end configured to connect to a second tubular; and a chamber disposed between the first and second ends; and a plug assembly disposed in the chamber and dividing the chamber into an up-hole portion and a downhole portion;

wherein the plug assembly comprises:

a first glass member having a predetermined residual surface compression, a first face, and at least one strength-reducing surface feature on the first face, wherein the first face and the strength-reducing surface feature face toward the downhole portion of the chamber; and a second glass member positioned uphole of the first glass member;

wherein a first clearance gap is radially positioned between the first glass member and the housing, wherein a second clearance gap is radially positioned between the second glass member and the housing, wherein the first clearance gap has a first width measured radially from the first glass member to the housing and the second clearance gap has a second width measured radially from the second glass member to the housing, wherein the first width of the first clearance gap is greater than the second width of the second clearance gap;

wherein the strength-reducing surface feature is configured to cause the first glass member to disintegrate when the first glass member is exposed to a pressure in the up-hole portion of the chamber having a magnitude that creates a tensile stress on the first face of the first glass member that exceeds the predetermined residual surface compression;

wherein the first clearance gap defines a space disposed about the first glass member configured to allow the first glass member to flex and expand radially outward in response to the pressure.

2. The subassembly of claim 1 further comprising an annular seal disposed about a portion of the plug assembly and sealing between the plug assembly and the housing.

3. The subassembly of claim 2 wherein the plug assembly comprises an annular retainer in the chamber and configured to retain the first glass member in position within the chamber.

4. The subassembly of claim 3 wherein the second glass member is positioned between the retainer and the first glass member.

5. The subassembly of claim 4 wherein the annular seal is disposed about the second glass member.

6. The subassembly of claim 5 wherein the plug assembly further comprises an annular cushion disposed between the first glass member and the housing.

7. The subassembly of claim 1 wherein the housing comprises a pair of elongate, axially aligned tubular members that are threadedly connected.

8. The subassembly of claim 1 wherein the first face includes a central region, and the strength-reducing surface feature is disposed in a portion of the first face that includes the central region.

9. The subassembly of claim 8 wherein the strength-reducing surface feature is selected from the group consisting of a recess, a scratch, an abrasion, an impact mark, an etching, and a surface irregularity.

10. The subassembly of claim 8 wherein the strength-reducing surface feature is created by a method selected from the group consisting of grinding, cutting, etching, grit blasting, abrading, and coating.

11. The subassembly of claim 8 wherein the strength-reducing surface feature comprises an enamel coating.

12. The subassembly of claim 1 wherein the predetermined residual surface compression is at least 10 k psi (68,900 kPa).

13. The subassembly of claim 12 wherein the first glass member is configured to fail when the pressure in the up-hole portion of the chamber is of a magnitude that creates a tensile stress in the first glass member that exceeds the predetermined residual surface compression by 2,000 psi (13,790 kPa) or less.

14. The subassembly of claim 1 wherein the first glass member is configured to fail when the pressure in the up-hole portion of the chamber is of a magnitude that creates a tensile stress in the first glass member that exceeds the predetermined residual surface compression by 5% of the residual surface compression or more.

15. A downhole tubular component for use in a completion string, the tubular component comprising:

a housing having a central axis and comprising a chamber disposed between first and second housing ends; and a plug assembly disposed in the chamber and dividing the chamber into an up-hole portion and a downhole portion;

wherein the plug assembly comprises:

a first glass member having a predetermined residual surface compression, a first face and a second face spaced apart from the first face, and a stress concentrator in the first face;

a second glass member positioned uphole of the first glass member;

wherein a first clearance gap is radially positioned between the first glass member and the housing, wherein a second clearance gap is radially positioned between the second glass member and the housing, wherein the first clearance gap has a first width measured radially from the first glass member to the housing and the second clearance gap has a second width measured radially from the second glass member to the housing, wherein the first width of the first clearance gap is greater than the second width of the second clearance gap;

wherein the stress concentrator is configured to cause the first glass member to fail when the plug assembly is exposed to a burst pressure in the up-hole portion of the chamber having a magnitude that, in comparison to the predetermined residual surface compression, creates a net positive tensile stress on the first face having the stress concentrator;

wherein the first clearance gap defines a space disposed about the first glass member configured to allow the first glass member to flex and expand radially outward when the plug assembly is exposed to the burst pressure; and wherein the plug assembly is disposed within the chamber such that the first face having the stress concentrator faces towards the downhole portion of the chamber.

16. The tubular component of claim 15 wherein the first glass member is a disk having a diameter D1;

wherein the first face having the stress concentrator includes a central region having a diameter D2 that is 75% of D1; and wherein the stress concentrator is at least partially within the central region.

17. The tubular component of claim 15 wherein the net positive tensile stress that is capable of causing the first glass member to fail has a value of 2,000 psi (13,790 kPa) or less.

18. The tubular component of claim 15 wherein the plug assembly further comprises a ring disposed between the first face of the first glass member and the housing.

19. A completion string comprising:

a gas-filled lower tubular segment;

an upper tubular segment configured to receive a liquid, wherein the upper tubular segment is positioned uphole relative to the lower tubular segment; and a plug assembly disposed in a housing positioned between the lower and upper tubular segments and having a breakable barrier separating the lower tubular segment from the upper tubular segment before the breakable barrier fails, wherein the housing has a central axis;

wherein the breakable barrier is configured to resist pressure in the liquid in the upper tubular segment and to fail when the pressure of the liquid is increased to exceed a predetermined burst pressure; and wherein the breakable barrier of the plug assembly comprises:

a first tempered glass member having a predetermined residual surface compression, a first face, and at least one strength-reducing surface feature on the first face, the strength-reducing surface feature being configured to cause the first glass member to fail when the breakable barrier is exposed to the predetermined burst pressure; and a second tempered glass member positioned uphole of the first tempered glass member;

wherein a first clearance gap is radially positioned between the first tempered glass member and the housing, wherein a second clearance gap is radially positioned between the second tempered glass member and the housing, wherein the first clearance gap has a first width measured radially from the first tempered glass member to the housing and the second clearance gap has a second width measured radially from the second tempered glass member to the housing, wherein the first width of the first clearance gap is greater than the second width of the second clearance gap;

wherein the first clearance gap defines a space disposed about the first tempered glass member configured to allow the first tempered glass member to flex and expand radially outward when the breakable barrier is exposed to the predetermined burst pressure;

wherein the first face and the at least one strength-reducing feature face toward the gas in the lower tubular segment.

20. The completion string of claim 19 wherein the first glass member has a residual surface compression of 10 k psi (68,900 kPa) or greater.

21. A flotation device for a tubular member, the flotation device comprising:

a tubular housing having a central axis and a chamber extending axially between first and second housing ends; and a plug assembly disposed in the chamber and dividing the chamber into an up-hole portion and a downhole portion, wherein the plug assembly comprises a breakable barrier including:

a first disk of tempered glass and having a face with a strength-reducing surface feature, wherein the face and the strength-reducing surface feature face toward the downhole portion of the chamber;

a second disc of tempered glass positioned uphole of the first disk of tempered glass;

wherein a first clearance gap is radially positioned between the first disc of tempered glass and the housing, wherein a second clearance gap is radially positioned between the second disc of tempered glass and the housing, wherein the first clearance gap has a first width measured radially from the first disc of tempered glass to the housing and the second clearance gap has a second width measured radially from the second disc of tempered glass to the housing, wherein the first width of the first clearance gap is greater than the second width of the second clearance gap; and an annular seal sealingly coupled between the tubular housing and the plug assembly to prevent fluid flow through the chamber until the first disk breaks;

wherein the first clearance gap defines a space disposed about the first disc configured to allow the first disc to flex and expand radially outward when the breakable barrier is exposed to a predetermined burst pressure.

22. The flotation device of claim 21 wherein the first disk is tempered to achieve a residual surface compression of 10 k psi (68,900 kPa) or greater.

23. The flotation device of claim 22 wherein the plug assembly comprises an annular retainer disposed in the chamber;

wherein the tubular housing includes a housing shoulder; and wherein the plug assembly is disposed between the housing shoulder and the retainer, the housing shoulder and the retainer limiting the movement of the plug assembly relative to the chamber.

24. The flotation device of claim 23 wherein the second disk is positioned between the first disk and the retainer; and wherein the annular seal engages the second disk.

25. The flotation device of claim 24 wherein the first disk is disposed such that the face with the strength-reducing surface feature faces away from the second disk.

26. The flotation device of claim 23, wherein the retainer comprises a plurality of adjustably-positioned feet disposed proximal the plug assembly to limit the movement of the plug assembly relative to the chamber.

27. The flotation device of claim 26 wherein the retainer further comprises a ring; and wherein the plurality of feet extend from the ring toward the plug assembly, the plurality of feet maintaining a non-zero distance between the plug assembly and the ring.

28. The flotation device of claim 23 wherein the housing shoulder is tapered; and wherein the flotation device further comprises a shoulder ring disposed between the housing shoulder and the plug assembly to support the plug assembly.

29. The flotation device of claim 22 wherein the strength-reducing surface feature is selected from the group consisting of a recess, a scratch, an abrasion, an impact mark, an etching, a surface irregularity, and a surface coating.

30. The flotation device of claim 21 wherein the first disk has a diameter D1;

wherein the face includes a central region having a diameter D2 that is 75% of D1; and wherein the strength-reducing surface feature intersects at least a portion of the central region of the face.

* * * * *